United States Patent [19]

Dacons et al.

[11] 4,011,265

[45] Mar. 8, 1977

[54] 3,3''-DIAMINO- OR 3,3''-DIMETHOXY-OCTANITRO-M-TERPHENYL

[75] Inventors: Joseph C. Dacons, Washington, D.C.; Richard R. Minesinger, Silver Spring, Md.

[73] Assignee: The United States of America as represented by the Secretary of the Navy, Washington, D.C.

[22] Filed: Mar. 19, 1970

[21] Appl. No.: 24,914

[52] U.S. Cl. ..... 260/578; 260/581; 149/105

[51] Int. Cl.[2] ..... C07C 87/60

[58] Field of Search ..... 149/105; 260/578, 581, 260/613 R

[56] References Cited

UNITED STATES PATENTS

| | | | |
|---|---|---|---|
| 3,320,320 | 5/1967 | Kamlet et al. | 260/581 |
| 3,402,202 | 9/1968 | Hein et al. | 260/581 |

*Primary Examiner*—Leland A. Sebastian

[57] ABSTRACT

3,3''-diamino-2,2'',4,4',4'',6,6',6''-octanitro-m-terphenyl and 3,3''-diamino-2,2'',4,4'',5',6,6''-heptanitro-m-terphenyl are prepared by contacting 3,3''-dimethozy-2,2",4,4',4",6,6',6"-octanitro-m-terphenyl and 3,3''-dimethoxy-2,2'',4,4'',5',6,6''-heptanitro-m-terphenyl with ammonia.

6 Claims, No Drawings

3,3''-DIAMINO- OR 3,3''-DIMETHOXY-OCTANITRO-M-TERPHENYL

BACKGROUND OF THE INVENTION

This invention generally relates to compounds which find use as explosives and more particularly to nitro group containing terphenyl explosives and to intermediates from which these explosives are prepared.

It is ordinarily of primary importance that an explosive be thermally stable so that when it is exposed to high temperatures either for an extended period of time or for a short period of time, it will not decompose. Additionally, if an explosive is to be exposed to radiation it is also important that it be radiation stable so that it will not decompose. Thus, in the prior art there has been a search for explosives which possess both thermal and radiation stability. Compounds such as 1,3-diamino-2,4,6-trinitrobenzene and 3,3'-diamino-2,2',4,4',6,6'-hexanitrobiphenyl have shown both thermal and radiation stability but the performance of these compounds has left much to be desired.

SUMMARY OF THE INVENTION

Accordingly, one object of this invention is to provide explosive compositions which possess good thermal stability.

Another object of this invention is to provide explosives which also possess good radiation stability.

A still further object of this invention is to provide novel intermediates from which the explosives can be prepared.

These and other objects are accomplished by providing the explosives 3,3''-diamino-2,2'',4,4',4'',6,6',6''-octanitro-m-terphenyl and 3,3''-diamino-2,2'',4,4'',-5',6,6''-heptanitro-m-terphenyl which are prepared by contacting 3,3''-dimethoxy-2,2'',4,4',4'',6,6',6''-octanitro-m-terphenyl and 3,3''-dimethoxy-2,2'',4,4'λ',5',6,6''-heptanitro-m-terphenyl respectively with ammonia.

DESCRIPTION OF THE PREFERRED EMBODIMENT 3,3''-diamino-2,2'',4,4',4'',6,6',6''-octanitro-m-terphenyl and 3,3''-diamino-2,2'',4,4'',5',6,6''-heptanitro-m-terphenyl are prepared by contacting 3,3''-dimethoxy-2,2'',4,4',4'',6,6',6''-octanitro-m-terphenyl and 3,3''-dimethoxy-2,2'',4,4'',5',6,6''-heptanitro-m-terphenyl with ammonia. Preferably the ammonia is added to the dimethoxy compounds at room temperature and the mixture is then heated.

3,3''-dimethoxy-2,2'',4,4',4'',6,6',6''-octanitro-m-terphenyl is prepared by reacting 1,5-dibromo-2,4-dinitrobenzene and 3-bromo-2,4,6-trinitroanisole in the presence of copper powder in a dry inert solvent at a temperature around 120°–140° C while 3,3''-dimethoxy-2,2'',4,4'',5',6,6''-heptanitro-m-terphenyl is prepared by contacting 1,3-diiodo-5-nitrobenzene and 3-bromo-2,4,6-trinitroanisole in a dry inert solvent in the presence of copper powder at a temperature between 120°–140° C. The reaction mixtures, after filtration, when steam distilled yield the dimethoxy intermediates.

The general nature of the invention having been set forth, the following examples are presented as specific illustrations thereof. It will be understood that the invention is not limited to these specific examples but is susceptible to various modifications that will be recognized by one of ordinary skill in the art.

EXAMPLE I 3,3''-DIAMINO-2,2'',4,4',4'',6,6',6''-OCTANITRO-M-TERPHENYL (DAONT)

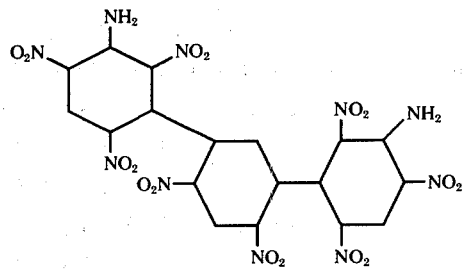

A slurry of copper powder with 50 ml. dry nitrobenzene was prepared in filtering, 500 ml. three-necked, round-bottomed flask fitted with a thermometer, mechanical stirrer and a dropping funnel. A solution of 16.3g, 1,5-dibromo-2,4-dinitrobenzene and 40.2g 3-bromo-2,4,6-trinitroanisole in 100 ml. dry nitrobenzene was placed in the dropping funnel. The solution was added dropwise, over a 10–15 minute period, to the stirred copper slurry which was heated to 125°–140° C. After addition heating was continued for 20 minutes. The reaction mixture was cooled to about 90° C. and filtered. The filter cake was washed thoroughly with acetone. The filtrate and washings were combined and steam distilled. The residue was dissolved in acetone, treated with decolorizing charcoal, added to 2–3 volumes of methanol and concentrated. A cream colored solid (24.5g), m.p. 265°–268° C was obtained after filtering, washing and drying. This product is 3,3''-dimethoxy-2,2'',4,4',4'',6,6',6''-octanitro-m-terphenyl (DMONT).

A suspension of 13g DMONT in 150 ml. of tetrahydrofuran and 150 ml. methanol was treated with excess gaseous ammonia for ½ hour. The suspension was heated to a slow boil for 3 hours and then cooled thoroughly. After filtering, washing with methanol and drying, 11.4g DAONT (92%), yellow-orange crystals, m.p. 345° C (dec), were obtained.

EXAMPLE II 3,3''-DIAMINO-2,2'',4,4'',5',6,6''-HEPTANITRO-M-TERPHENYL (DAHNT)

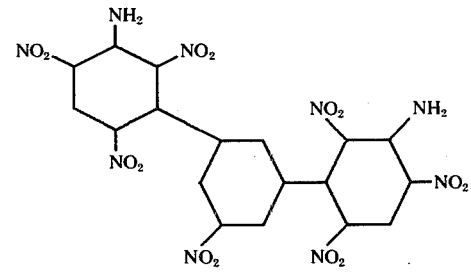

A mixture of 7.5g 1,3-diiodo-5-nitrobenzene, 12.7g copper powder, and 50 ml. dry nitrobenzene was prepared in a 250 ml. three-neck, round-bottomed flask fitted with a thermometer, mechanical stirrer, and dropping funnel. A solution of 16.1 g 3-bromo-2,4,6-trinitroanisole in 75 ml. dry nitrobenzene was placed in a dropping funnel and was added to the reaction flask over a 45 minute period while the flask was kept at 130°–160° C. The reaction mixture was filtered while warm and the filter cake was washed thoroughly with acetone. The filtrate and washings were then steam distilled The residue was dissolved in acetone, treated with decolorizing charcoal, filtered, concentrated and 5 volumes of methanol were added. After thorough cooling, filtering washing with methanol and drying, 9.9g (82%) 3,3''-dimethoxy-2,2'',4,4'',5',6,6''-heptanitro-m-terphenyl (DMHNT), m.p. 234°–236° C, were obtained.

A solution of 6.8g DMHNT in 50 ml. tetrahydrofuran and 50 ml. methanol were treated with excess gaseous ammonia for ½ hour. After boiling, adding another volume of methanol and cooling 5.9g DAHNT, m.p. 355° C (dec) were obtained.

Obviously, numerous modifications and variations of the present invention are possible in light of the above teachings. It is therefore to be understood that within the scope of the appended claims the invention may be practiced otherwise than as specifically described herein.

What is claimed as new and desired to be secured by Letters Patent of the United States is:

1. A compound according to the formula

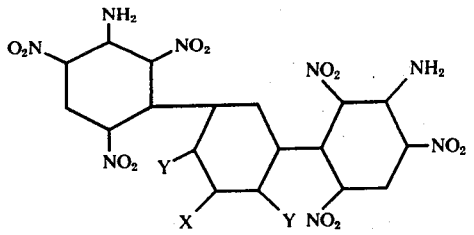

wherein X and Y are selected from the group consisting of H and $NO_2$ provided that when X is H, Y is $NO_2$ and when Y is H, X is $NO_2$.

2. A compound according to claim 1 which is 3,3''-diamino-2,2'',4,4',4'',6,6',6''-octanitro-m-terphenyl.

3. A compound according to claim 1 which is 3,3''-diamino-2,2'',4,4'',5',6,6''-heptanitro-m-terphenyl.

4. A compound according to the formula

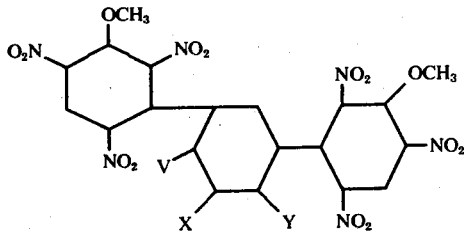

wherein X and Y are selected from the group consisting of H and $NO_2$ provided that when X is H, Y is $NO_2$ and when Y is H, X is $NO_2$.

5. A compound according to claim 4 which is 3,3''-dimethoxy-2,2'',4,4',4'',6,6',6''-octanitro-m-terphenyl.

6. A compound according to claim 4 which is 3,3''-dimethoxy-2,2'',4,4'',5',6,6''-heptanitro-m-terphenyl.

* * * * *